US007900644B2

(12) United States Patent
McGee

(10) Patent No.: US 7,900,644 B2
(45) Date of Patent: Mar. 8, 2011

(54) WALKING STICK FOR COLLECTING FECAL MATTER

(76) Inventor: David Clifford McGee, Picton (CA)

( * ) Notice: Subject to any disclaimer, the term of this patent is extended or adjusted under 35 U.S.C. 154(b) by 0 days.

(21) Appl. No.: 12/150,703

(22) Filed: May 1, 2008

(65) Prior Publication Data

US 2008/0257393 A1 Oct. 23, 2008

Related U.S. Application Data

(60) Provisional application No. 60/928,075, filed on May 8, 2007.

(30) Foreign Application Priority Data

Mar. 14, 2007 (CA) ..... 2581705

(51) Int. Cl.
*A45B 3/00* (2006.01)
*A44B 9/04* (2006.01)

(52) U.S. Cl. ..... 135/66; 135/79; 135/81; 294/50.6

(58) Field of Classification Search ..... 135/65–66, 135/70, 77–81; 175/394; 172/25, 111; 294/19.3, 294/65.5, 50.5–50.6
See application file for complete search history.

(56) References Cited

U.S. PATENT DOCUMENTS

| | | | | | |
|---|---|---|---|---|---|
| 2,689,762 | A * | 9/1954 | Krumm | 294/50.6 |
| 3,093,402 | A * | 6/1963 | Sisson | 294/19.1 |
| 3,554,293 | A * | 1/1971 | Aman et al. | 172/13 |
| 4,711,482 | A * | 12/1987 | Brown et al. | 294/19.1 |
| 4,735,189 | A * | 4/1988 | Murphy et al. | 126/242 |
| 4,827,956 | A * | 5/1989 | Toot | 135/66 |
| 4,832,131 | A * | 5/1989 | Powell et al. | 172/25 |
| 5,865,259 | A * | 2/1999 | Catto | 172/25 |
| 6,550,490 | B1 * | 4/2003 | Morton et al. | 135/66 |

* cited by examiner

*Primary Examiner* — Winnie Yip
(74) *Attorney, Agent, or Firm* — Todd L. Juneau

(57) ABSTRACT

This invention provides an improved way in which dog feases can be picked up from outside areas and be exposed. The apparatus consists of a light and well balanced walking cane or stick with a cup attached at the lower end of the cane. Inside the cup is an auger that is turned by a battery driven two-way motor. The handle of the cane holds the batteries which drive the motor and the switch starts the motor in forward or reverse drive. The user can easily, while walking his/her dog remove dog droppings from public and/or private areas, while disposing them quickly and conveniently. The cane or stick is designed to auger up, hold, and then deposit dog droppings with little effort and help keep yards, parks and walkways clean.

3 Claims, 2 Drawing Sheets

WALKING STICK FOR COLLECTING FECAL MATTER

This application claims the benefit and priority to U.S. Provisional Application No. 60/928,075 filed on May 8, 2007, and the foreign priority benefit under 35 U.S.C. §119 (a)-(d) to a CANADA Patent Application No. 2,581,705, filed Mar. 14, 2007.

FIELD OF THE INVENTION

This invention relates to a walking stick or cane specially adapted for the purpose collecting fecal matter, in particular for picking up dog droppings.

BACKGROUND OF THE INVENTION

Most municipalities require dog owners to pick up after their dogs in public areas. People are more likely to clean up after their dogs if they do not have to bend over and pick up dog droppings by hand. A device which could be used with little effort to pick up dog droppings would help keep yards, parks and walkways clean.

It is an object of the present invention to provide a walking stick that can be used to collect fecal matter.

It is a further object of the present invention to provide a walking stick which can be used with little effort, and avoids the need for an user to bend over to pick up dog droppings.

It is yet a further object to provide a walking stick which can hold fecal matter, so that it can be transported inside the walking stick to a location for proper disposal.

BRIEF SUMMARY OF THE INVENTION

A walking stick for collecting fecal matter is provided. The walking stick has a housing. An auger is mounted within a cup at the base of the housing. The auger is in operative connection with a two way motor. The motor is controlled by a switch to selectively rotate the auger in a forward direction or a reverse direction.

DETAILED DESCRIPTION OF THE INVENTION

Figure 1:
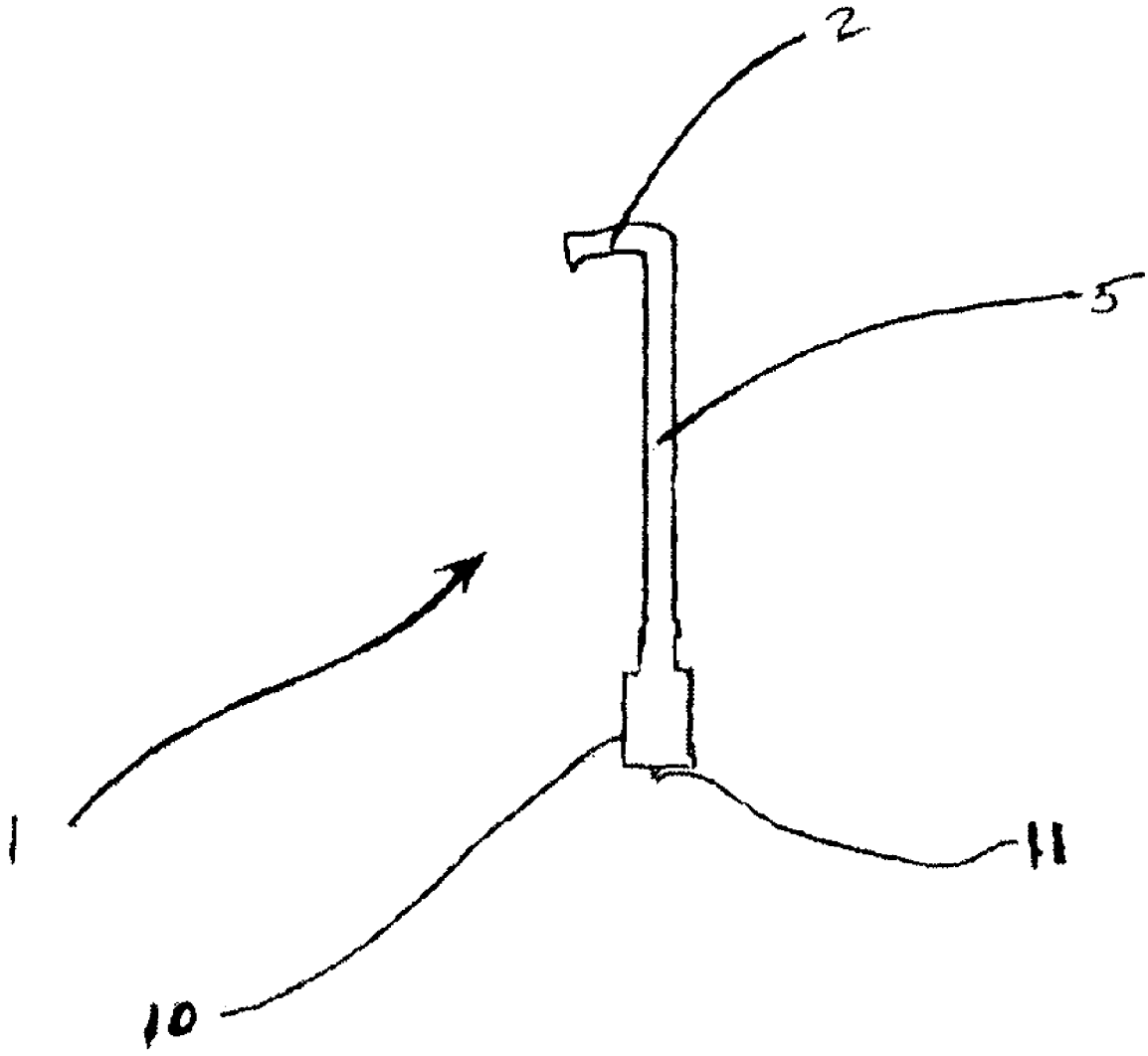
FIG. 1 is a perspective view of a walking stick according to the present invention.
Figure 2:
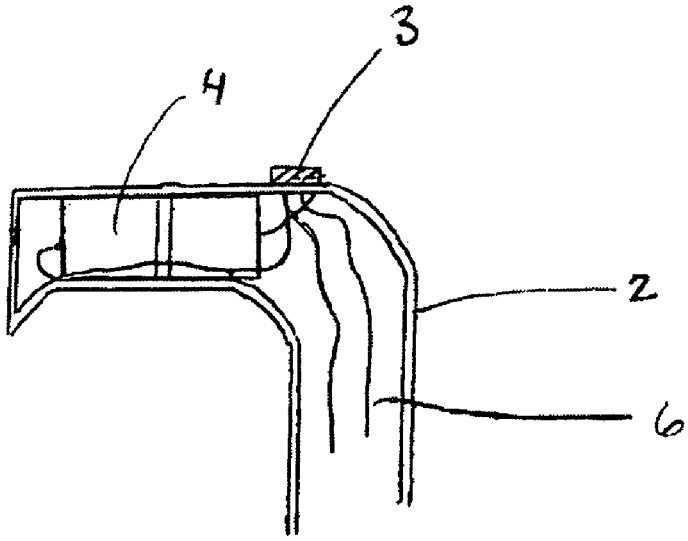
FIG. 2 is a longitudinal sectional view of the handle of the walking stick of FIG. 1.
Figure 3:
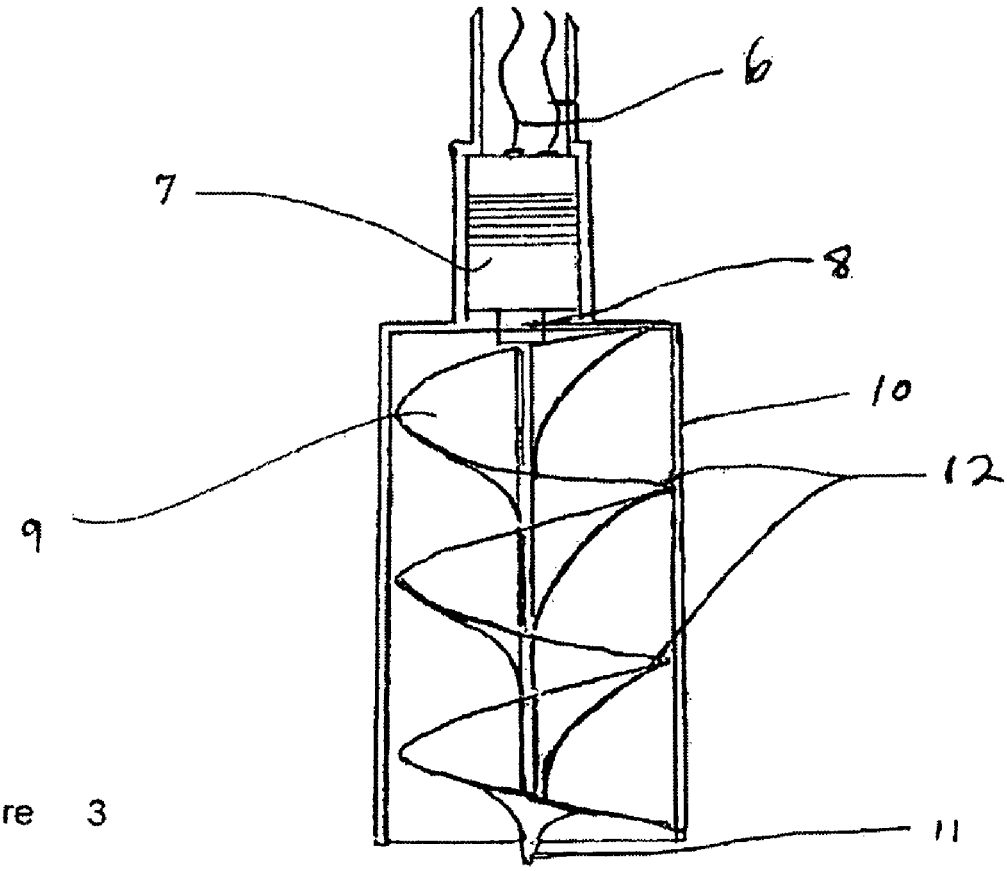
FIG. 3 is a longitudinal sectional view of the bottom portion of the walking stick of FIG. 1.

This particular invention comprises a cane or walking stick which is also fitted with a cup and auger for the sole purpose for cleaning up dog droppings or feces from outside areas. The walking stick of the present invention is generally indicated by reference numeral 1, and is shown in perspective view in FIG. 1. The walking stick has a handle 2 and a shaft or cane 5. As best seen in FIGS. 2 and 3, the handle 2 and the cane 5 are hollow and serve as a housing for the other components of the walking stick.

An auger 9 is mounted at the base of the cane 5 in operative connection, through the final drive 8, with a motor 7. The auger 9 has blades 12 in helical flighting and is enclosed within the hollow of the cup 10. The auger 9, is driven by the small battery powered electrical two-way motor 7. The battery or power pack 4 which powers the motor 7 is contained in the handle 2 of the cane 5. The motor 7 is turned to forward, off, or reverse, by a switch 3, which in a preferred embodiment of the present invention, sits on top of the cane handle 2. The wiring from the batteries, switch 3, and motor 7 are shown in part by reference numeral 6. The motor 7 is attached to the auger 9 by a final drive 8.

The auger 9 is able to pick up fecal matter in the following manner. The switch 3 is switched to a forward position, which activates the motor 7 in a first direction to cause the drive 8 to rotate the auger 9 in a first direction such that the rotation of the auger 9 is in an upward direction. The walking stick 1 is placed over the fecal matter bringing the blades 12 of the auger 9 into contact with the fecal matter. The relative motion of the helical flighting of blades 12, as the auger 9 rotates in a first direction, lifts the fecal matter upward. The fecal matter is supported on the blades 12 of the auger 9 and is retained within the cup 10. The switch 3 is then switched to the off position. The motor 7 is stopped and the auger 9 also stops rotating. The fecal matter remains supported on the blades 12 of the auger and retained within the cup 10. The walking stick can then be transported during the ordinary course of a user's walk. When the user reaches a location where the fecal matter can be disposed of, the switch is switched to the reverse position, thereby engaging the motor 7, and rotating the auger 9 in the reverse direction. There is a downward relative motion of the helical flighting of the blades 12 as the auger 9 rotates. The fecal matter supported on the blades 12 is lowered by the relative motion and is allowed to drop out of the cup 10 into a suitable waste receptacle, such as a trash can, or trash bag.

The cane or walking stick provides a user friendly balanced feel to the apparatus.

At the base of the auger 9 is a retractable point, part 11. The retractable point 11 is extended below the cup 10 when the walking stick 1 is being used for walking to help protect the base of the cup 10 from wear and tear as the walking stick is swung and tapped on the ground in the ordinary course of walking.

I claim:

1. A walking stick for collecting fecal matter comprising: an elongated housing, a handle mounted on an upper end of said housing, a cup disposed on a base of said housing, an auger having blades being rotatably mounted within the cup at the base of the housing, said auger being in operative connection with a two way motor, a battery being contained in said handle to electrically power said two way motor, said two way motor being controlled by a switch to selectively rotate the auger inside of said cup in a forward direction for collecting fecal matter being moved along said auger in an axis of the rotation to be held inside said cup and in a reverse direction for releasing the fecal matters from said cup.

2. The walking stick of claim 1, wherein said housing comprises a hollow shaft.

3. The walking stick of claim 1, further comprising a retractable point at the base of the auger.

* * * * *